US008965637B2

(12) United States Patent
Brooks et al.

(10) Patent No.: US 8,965,637 B2
(45) Date of Patent: Feb. 24, 2015

(54) METHOD OF OPERATING A WORKING MACHINE

(75) Inventors: Richard Anthony Brooks, Stoke on Trent (GB); Graham Mark Brooks, Stoke on Trent (GB); Kevin William Ford, Stoke on Trent (GB)

(73) Assignee: J.C. Bamford Excavators Limited, Uttoxeter, Staffordshire (GB)

( * ) Notice: Subject to any disclaimer, the term of this patent is extended or adjusted under 35 U.S.C. 154(b) by 828 days.

(21) Appl. No.: 12/817,858

(22) Filed: Jun. 17, 2010

(65) Prior Publication Data

US 2010/0322753 A1 Dec. 23, 2010

(30) Foreign Application Priority Data

Jun. 19, 2009 (GB) ..... 0910617.0

(51) Int. Cl.

| | |
|---|---|
| ***B66F 9/20*** | (2006.01) |
| ***B66F 17/00*** | (2006.01) |
| ***E02F 3/43*** | (2006.01) |
| ***E02F 9/20*** | (2006.01) |

(Continued)

(52) U.S. Cl.

CPC ..... *B66F 17/003* (2013.01); *E02F 3/437* (2013.01); *E02F 9/2029* (2013.01); *B66C 23/90* (2013.01); *B66F 9/0655* (2013.01)

USPC ..... 701/50; 414/699; 414/700; 414/701; 414/718; 414/815

(58) Field of Classification Search

CPC ..... B66F 17/003; B66F 9/0655; E02F 3/437; E02F 9/2029

USPC ..... 414/699, 700, 701, 800; 701/50

See application file for complete search history.

(56) References Cited

U.S. PATENT DOCUMENTS

| | | | |
|---|---|---|---|
| 4,006,347 | A | 2/1977 | Hohmann |
| 4,042,135 | A | 8/1977 | Pugh et al. |
| 4,319,864 | A | 3/1982 | Kaufeldt |

(Continued)

FOREIGN PATENT DOCUMENTS

| | | | |
|---|---|---|---|
| BE | 838150 | A1 | 5/1976 |
| EP | 0059901 | A1 | 9/1982 |

(Continued)

OTHER PUBLICATIONS

Search Report for EP 10 16 2996, dated Oct. 21, 2010.

*Primary Examiner* — Scott Lowe

(74) *Attorney, Agent, or Firm* — Marshall, Gerstein & Borun LLP

(57) ABSTRACT

A method of operating a working machine which includes a main structure and a working arm pivotally mounted at one end on the main structure. The working arm is raisable and lowerable relative to the main structure by a first actuator device, and is extendible relative to the main structure by a second actuator device. In use, the arm carries at another end a working implement which can carry a load. The machine further including a ground engaging drive structure by which the machine is drivable on the ground. The machine has a longitudinal load moment control system which automatically disables operation of the first and/or second actuator devices from increasing longitudinal instability in the event that a predetermined instability is sensed. When the machine senses a ground travelling speed above a threshold speed, the longitudinal load moment control system is disabled.

15 Claims, 2 Drawing Sheets

(51) Int. Cl.
*B66C 23/90* (2006.01)
*B66F 9/065* (2006.01)

(56) References Cited

U.S. PATENT DOCUMENTS

| | | | | |
|---|---|---|---|---|
| 4,822,237 | A | 4/1989 | Meyer et al. | |
| 5,058,752 | A | 10/1991 | Wacht et al. | |
| 5,257,177 | A | 10/1993 | Bach et al. | |
| 7,797,860 | B2 * | 9/2010 | Schoenmaker et al. | 414/699 |
| 2006/0103336 | A1 * | 5/2006 | Brooks et al. | 318/139 |
| 2008/0263909 | A1 * | 10/2008 | Schoenmaker et al. | 37/348 |
| 2009/0157266 | A1 | 6/2009 | Krimbacher | |

FOREIGN PATENT DOCUMENTS

| | | | |
|---|---|---|---|
| EP | 0063709 | A1 | 11/1982 |
| EP | 0735980 | | 10/1986 |
| EP | 0206940 | A1 | 12/1986 |
| EP | 0735980 | A1 | 10/1996 |
| EP | 1043266 | A2 | 10/2000 |
| EP | 1043266 | A2 | 10/2000 |
| FR | 2105802 | A5 | 4/1972 |
| FR | 2189301 | A1 | 1/1974 |
| FR | 2287413 | * | 7/1976 |
| FR | 2461676 | A1 | 2/1981 |
| FR | 2574389 | A1 | 6/1986 |
| FR | 2 750 972 | A1 | 1/1998 |
| FR | 2849075 | A1 | 6/2004 |
| GB | 1361832 | | 7/1974 |
| GB | 1361832 | A | 7/1974 |
| GB | 1403046 | | 8/1975 |
| GB | 1440614 | A | 6/1976 |
| GB | 1495675 | | 12/1977 |
| GB | 1528741 | | 10/1978 |
| GB | 2116518 | | 9/1983 |
| GB | 2390595 | | 1/2004 |
| JP | 5-202535 | | 8/1993 |
| JP | 6-263394 | | 9/1994 |
| JP | 2000-104290 | | 4/2011 |
| RU | 2114049 | C1 | 6/1998 |

* cited by examiner

METHOD OF OPERATING A WORKING MACHINE

CROSS-REFERENCE TO RELATED APPLICATIONS

Priority is claimed to United Kingdom patent application Serial No. 0910617.0 filed Jun. 19, 2009.

STATEMENT REGARDING FEDERALLY SPONSORED RESEARCH OR DEVELOPMENT

Not Applicable.

TECHNICAL FIELD

This invention relates to a method of operating working machine of the kind which is drivable on the ground and which has a working arm carrying at an outermost end, a working implement such as a loading forks or loading bucket for examples.

BACKGROUND OF THE INVENTION

Working machines which are used for loading and unloading, are prone to longitudinal instability when handling loads at height, and/or at distance from a main structure of the machine. At least in Europe, it is a statutory requirement for such machines to be provided with a longitudinal load moment control system which automatically prevents operation of the working arm at least in a manner which could increase the longitudinal instability of the machine beyond a safe limit. It is also a requirement for such machines to have a longitudinal moment indicator to provide a warning to an operator of an impending longitudinal unstable condition.

A longitudinal load movement control system is an essential safety feature particularly where such a machine is used in public places or places where there are workers, such as on the highway or on construction sites. It is also a requirement for such machines which are used for loading and unloading operations that such operations are carried out while the machine is stationary, and that when the machine is travelling on the ground, the working arm when the implement is loaded, is substantially lowered. According to the legislation, the longitudinal load moment control system may be disabled when the working arm is fully retracted.

Where such machines are used in an agricultural context, commonly the surface on which the machine has to travel when being driven from one location to another location, is particularly uneven. Known longitudinal load moment control systems are provided on all working machines regardless of their intended use. It will be appreciated that when a machine provided with such a longitudinal load moment control system is used in an agricultural context i.e. the machine is driven on particularly uneven ground, a longitudinal load sensor of the control system may be subject to transient forces which falsely indicate longitudinal instability, and so the longitudinal load control system may operate automatically to prevent or stop operation of the working arm when this is not required. This false indication can actually lead to an increase in the machine's instability.

BRIEF SUMMARY OF THE INVENTION

According to a first aspect of the invention we provide a method of operating a working machine which includes a main structure, and a working arm, the working arm being pivotally mounted on the main structure at one end of the arm, the working arm being raisable and lowerable relative to the main structure by a first actuator device, and being extendible relative to the main structure by a second actuator device, and the arm carrying in use at its other end a working implement which in use carries a load. The machine may further include a ground engaging drive structure by which the machine is driveable on the ground, and the machine having a longitudinal load moment control system which is functional automatically to disable the operation of the first and/or second actuator device which would increase longitudinal instability in the event that a predetermined machine longitudinal instability is sensed. The method may include sensing a parameter relating to the travelling speed of the machine on the ground, and where the machine is determined to be travelling at a speed above a threshold speed, disabling the longitudinal load moment control system.

By virtue of the invention, a machine is provided in which the longitudinal load moment control system is operational to protect against excess longitudinal instability beyond the predetermined instability during loading and unloading operations when the machine is stationary or at least travelling at below the threshold speed, thus to protect the machine against overturning. However when the machine travels at above the threshold speed, the load moment control system is disabled, so that the working arm can be raised or lowered or extended without the operation of any actuator being disabled by the longitudinal load moment control system. Even though the longitudinal load movement control system may be disabled, the load movement indicator will continue to provide a visual indication to the operator of the longitudinal stability status of the machine.

Thus in for example a construction site context, when loading and unloading is only permitted when the machine is stationary, and the machine may only travel when loaded with the working arm in a lowered and retracted condition, full safety is provided. In an agricultural context, the operator may use the machine without the load moment control system operating such as to affect his ability to operate the first and second actuator devices.

In one example the working machine is of the kind in which the working arm is a loading arm which is pivoted relative to the main structure for up and down movement about a generally horizontal axis, at the one end of the working arm, typically at a rear position on the main structure, the working arm extending forwardly beyond the main structure at the other end, where the working implement is provided. The first actuator device (which may include one or a plurality of actuators) may extend between the main structure and the loading arm, the first actuator device being extendable to raise the arm and retractable to lower the arm, whilst the longitudinal load moment is sensed.

The loading arm may be telescopic, having a plurality of arm sections, the second actuator device (which again may include one or a plurality of actuators) extending between adjacent sections of the arm, which second actuator device is extendable or retractable to extend or retract the loading arm, whilst sensing the longitudinal load moment.

The first and second actuator devices may be provided in a hydraulic circuit which includes a longitudinal load moment control system device which is operable under the control of a controller, to prevent the flow of hydraulic fluid to or from one of or each of the actuator devices when the longitudinal load moment control system is operational and longitudinal instability is sensed which is greater than the predetermined machine longitudinal instability.

Preferably the method may include sensing the travelling speed of the machine on the ground by sensing movement of the machine relative to the ground, e.g. using a ground speed radar, or the speed of the machine may be sensed by sensing movement of a part of the ground engaging drive structure which moves as the machine moves on the ground, e.g. a wheel or axle rotation, so that whether the machine is driven or coasting, the method of the invention may be performed. However the method may include sensing the movement of a transmission component, such as the engagement of a clutch element or gear of the transmission, or the rotational speed of a transmission component such as a gear or shaft, to determine whether the travelling speed of the machine over the ground is above or below the threshold speed. Further alternatively, the braking status of the machine may be sensed, or movement of a component of a foot brake, or a parking brake. In each case the method may include providing a signal to a controller indicative of the machine travelling speed, the controller disabling the longitudinal load moment control system when the travelling speed is determined to be above the threshold speed.

In one example, the threshold speed may be zero kph, but in any event is preferably less than 5 kph and more preferably is not more than 0.5 kph.

According to a second aspect of the invention we provide a working machine which includes a main structure and a working arm, the working arm being pivotally mounted on the main structure, at one end of the arm, the working arm being raisable and lowerable relative to the main structure by a first actuator device, and being extendible relative to the main structure by a second actuator device, and the arm carrying in use at its other end a working implement which in use carries a load. The machine may further include a ground engaging drive structure by which the machine is driveable on the ground. The machine may have a longitudinal load moment control system which is functional automatically to disable the operation of the first and/or second actuator device which would increase longitudinal instability in the event that a predetermined machine longitudinal instability is sensed. The machine may further include a sensor to sense a parameter relating to the travelling speed of the machine on the ground, and to provide a signal to a controller indicative of whether the travelling speed of the machine is above or below a threshold speed, and where the machine is determined to be travelling at a speed above a threshold speed, the controller disabling the longitudinal load moment control system.

DETAILED DESCRIPTION OF THE INVENTION

Figure 1:
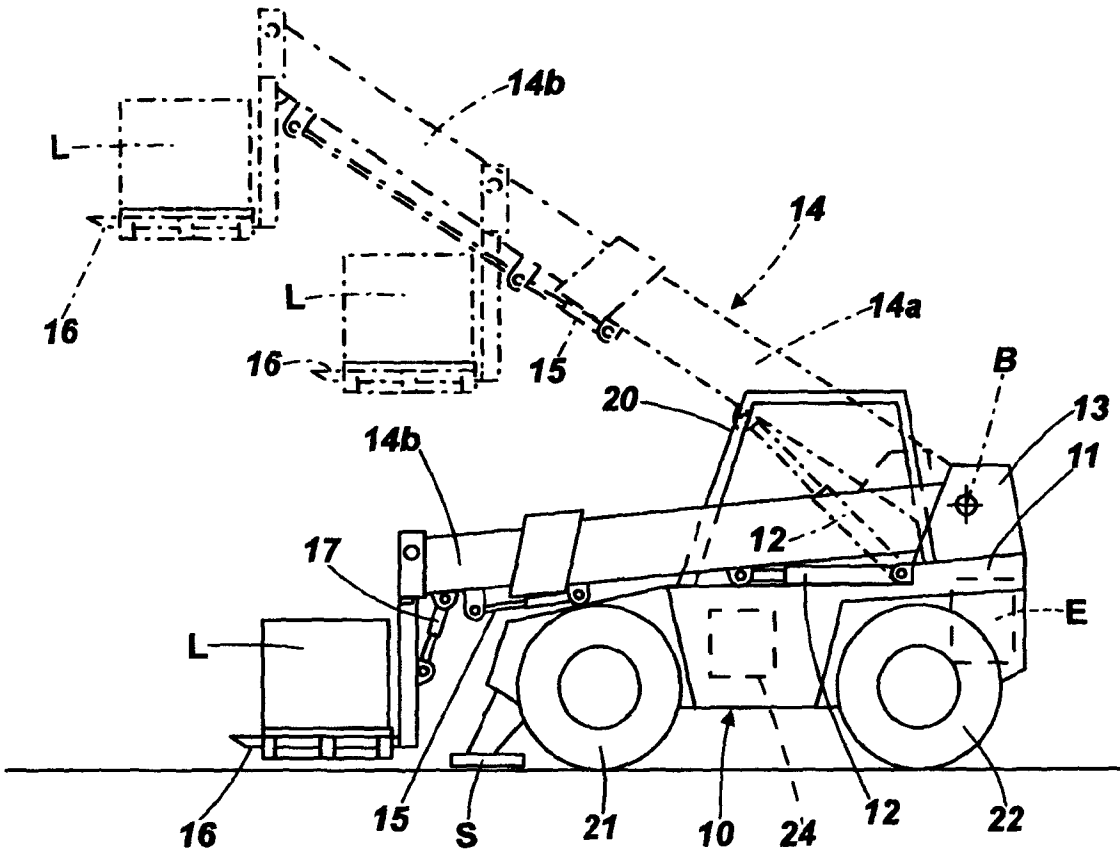
FIG. 1 is a side illustrative view of a working machine which may be operated in accordance with the invention, showing a working arm in various alternative conditions.

Referring to FIG. 1 a working machine 10 is shown which in the example is a loading machine having a main structure which is a body 11, on which is mounted at a rear position of the body 11, one end 13 of a working arm 14, for pivoting movement of the arm 14 about a generally horizontal axis B relative to the body 11. The arm 14 is raisable and lowerable about the axis B by virtue of a first actuator device 12 which may include one or a plurality of preferably double acting hydraulic actuators.

The arm 14 is also extendable and retractable by virtue of having a plurality (only two in the example in the drawings) of telescopic sections 14*a*, 14*b*, there being a second actuator device 15, which again may be one or a plurality of preferably double acting hydraulic actuators, to effect relative extension and retraction of the arm sections 14*a*, 14*b*.

In FIG. 1 the arm 14 is illustrated in a fully lowered and retracted condition, and a raised and extended condition.

At its outermost end, i.e. the end of the arm 14 remote from the pivot axis B, the arm 14 carries a working implement 16 which in the example shown, is a loading forks 16. The forks 16 are shown carrying a load L. The loading forks 16 are pivotal relative to the arm 14 about a generally horizontal axis D by another actuator device indicated at 17.

The arm 14 is mounted about axis B at a rear end of the body 11 and extends forwardly of a front end of the body 11. The body 11 mounts an operator's cab 20 from where an operator may control the raising and lowering and extension and retraction of the working arm 14, and pivoting of the loading implement 16, using manual controls which operate hydraulic controls valves for the actuator devices 12, 15, 17. Also, from within the cab 20 the operator may drive the machine 10 on the ground, the machine 10 including a ground engaging drive structure to enable this. The ground engaging drive structure includes in this example a front pair of wheels 21 and a rear pair of wheels 22, at least the front wheels 21 being steerable and at least the rear wheels 22 being drivable via a transmission 24 from an engine E.

The machine 10 includes a longitudinal load moment control system which is effective to protect the machine 10 against overturn due to longitudinal instability during load handling. The control system includes a sensor 30 on a rear axle 19 which carries the rear wheels 22. The rear axle 19 is pivoted to the body 11 for movement about a generally horizontal axis A which is substantially perpendicular to axis B about which the loading arm 14 pivots, and centered on a machine centerline C shown in FIG. 2. The sensor 30 may include at least one stress gauge which provides an electrical signal to a control system controller 32 as indicated in FIG. 3. The controller 32 determines from the signal from the load sensor 30 whether the longitudinal load moment is within or not, a safe limit. In another example, the load sensor 30 may only provide a signal to the controller 32 when an unsafe longitudinal load moment is sensed.

In each case, when an unsafe longitudinal load moment is sensed i.e. a moment greater or less than a predetermined moment, the controller 32 is arranged to respond by automatically disabling the operation of any actuator device 12/15/17 which would increase longitudinal instability further.

In the illustration in FIG. 3 there is shown a control valve 34 which receives pressurized hydraulic fluid from a source such as a pump P, and depending upon the operation of a manual control in the cab 20, the control valve 34 directs pressurized hydraulic fluid to an actuator device 12/15/17. The longitudinal load moment control system includes a load safety valve 35 between the control valve 34 and the actuator device 12/15/17, which is electrically operated in this example. In the event that the controller 32 determines that there is longitudinal instability beyond a predetermined longitudinal instability, the load safety valve 35 is closed to prevent the flow of more hydraulic fluid to the actuator device 12/15/17. Thus the machine 10 is protected against any further longitudinal instability which otherwise could occur upon any further actuator device 12/15/17 operation.

In another example (not shown), instead of the load safety valve 35 being between the control valve 34 and an actuator device 12/15/17, a load safety valve 35 may be provided between the pump P and the control valve 34. Where the control valve 34 is electronically operated or pilot operated, if desired, the longitudinal load moment control system may be incorporated into a system controller which provides an electrical or pilot signal to the control valve 34 in response to the operation of a manual operator control to operate the control valve 34, in normal operation, but which interrupts the signal to the control valve 34 when the sensor 30 senses a longitudinal instability greater than a predetermined instability. Thus a separate load safety valve 35 or similar device may not be required.

It will be appreciated that a typical control valve 34 will include a spool which is resiliently biased to a position in which no pressurized hydraulic fluid passes to the downstream actuator 12/15/17. Thus in the absence of an electrical or pilot control signal to move the spool against the resilient biasing, the spool will return to its "no flow" position and the actuating device 12/15/17 will be disabled.

In the example, it will be appreciated that the longitudinal instability of the machine 10 may increase upon a loaded loading arm 14 being raised and/or extended during a loading or unloading operation, or upon the arm 14 being lowered whilst extended. The longitudinal stability of the machine 10 about a tipping axis which in the example coincides with the rotational axis of the front wheels 21 depends on the load L, and the height, and extension of the loading arm 14, i.e. the distance of the load from the body 11.

In operation of such a working machine 10 on a construction site for example, typically the machine 10 would be stationary during loading or unloading operations. As desired, one or more (usually a pair) of stabilizers S may be lowered from the body 11 into engagement with the ground to move the tipping axis longitudinally. However in each case the machine 10 is protected against longitudinal instability by the longitudinal load moment control system.

It will be appreciated that the part of the hydraulic circuit of the machine 10 shown in FIG. 3 is incomplete and is only included to aid understanding. A practical such circuit would include a plurality of control valves 34, perhaps provided in a common valve block or not, and lines to provide hydraulic fluid to and from both sides of the actuator devices 12/15/17. A plurality of load safety valves 35 may be required to prevent the flow of pressurized fluid to or from one or more or all of the actuator devices 12/15/17, as necessary and desired, to prevent any further increase in longitudinal stability beyond the predetermined safe threshold.

The longitudinal load moment control system may be more sophisticated than is suggested in the drawings, and may be operational to disable the operation of only a particular actuator device 12/15/17 the operation of which is giving rise to a longitudinal instability machine condition, or the longitudinal load moment control system may operate to reduce the operation of at least one actuator device 12/15/17 at a first threshold of operation, and stop operation of the actuator device 12/15/17 at a second threshold of operation.

If desired, there may be an input to the controller 32 to indicate when the loading arm 14 has been fully retracted. Upon receipt of such a signal, the longitudinal load moment control system may be disabled, so that as the machine 10 travels on the ground and the longitudinal load moment sensor 30 is subject to transient forces which could falsely indicate longitudinal instability beyond the safe limit, the actuator devices 12/15/17 are not prevented from being operated. Such disabling of the longitudinal load control system may be desirable where e.g. upon closing of the or one of the safety valves 35 or otherwise upon actuation of the longitudinal load movement control system to prevent the flow of fluid to the actuator 12/15/17, a system reset is required, or other special steps need to be taken to restore the hydraulic system to a normal operating condition.

In accordance with the present invention, the machine 10 includes a sensor 40 to provide an input to the controller 32 indicative of the machine 10 travelling speed on the ground. At its simplest the controller 32 receives a signal from a machine 10 sensor 40 which senses movement of a part of the ground engaging drive structure such as an axle or wheel 19,21,22, which signal at least indicates if the machine 10 travelling speed is above or below a threshold speed. In accordance with the invention, such threshold speed is preferably zero kph or close to zero, for example preferably less than 5 kph and more desirably not greater than 0.5 kph.

In another example, a signal may be provided from a sensor which senses the movement e.g. rotation, of a part of the transmission 24, such as a gear or a shaft of the transmission, or a, not necessarily rotational, movement of an element of a clutch of the transmission 24 during speed and/or ratio selection, or of any other part movement of which is indicative of the travelling speed of the machine 10.

In another example, the sensor 40 may sense movement of the machine 10 relative to the ground and so may be for example, a component of a ground speed radar.

In yet another example the sensor 40 may sense movement or operation of another machine 10 part which is dependent upon travelling speed, such as of a part of a braking system of the machine 10, e.g. of the machine foot brake or parking brake, or otherwise the braking status of the machine may give an indication of machine 10 travelling speed.

In each case the controller 32 may respond to the signal to determine the travelling speed, or the speed indication sensor 40 may only signal the controller 32 upon the travelling speed being determined to be above or below the threshold value. In every case, the controller 32 is responsive to a machine 10 travelling speed above a threshold speed.

Where the travelling speed is determined by the controller 32 to be less than the threshold speed, the longitudinal load moment control system remains fully operational as described above to protect the machine 10 when an unsafe longitudinal load moment is determined.

However when travelling speed is determined to be above the threshold speed, in accordance with the present invention, irrespective of whether the loading arm 14 is raised or lowered, or retracted or not, the controller 32 disables the longitudinal load moment control system, permitting the operator to operate the actuator devices 12/15/17 at will.

In any event, a load movement indicator 31 which is provided in the cab 20 will remain fully operational to indicate to the operator the longitudinal stability status of the machine 10, so even when the longitudinal load movement control system is disabled. Thus, the operator may still be made aware of any impending longitudinal instability. Such an indicator 31 typically includes a plurality of indicator lights an increasing number of which are lit as machine instability increases, and possibility with there being an audible alarm as an impending instability condition is determined.

Figure 2:
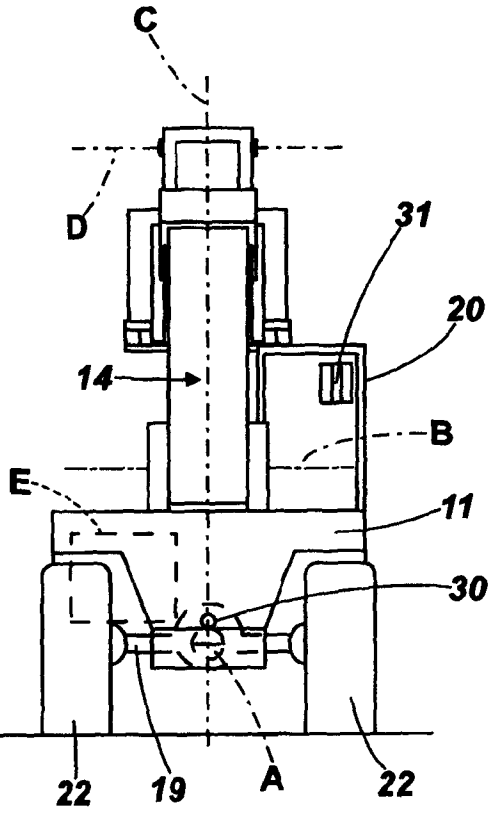
FIG. 2 is a rear view of the machine of FIG. 1 but showing the working arm in a single condition.
Figure 3:
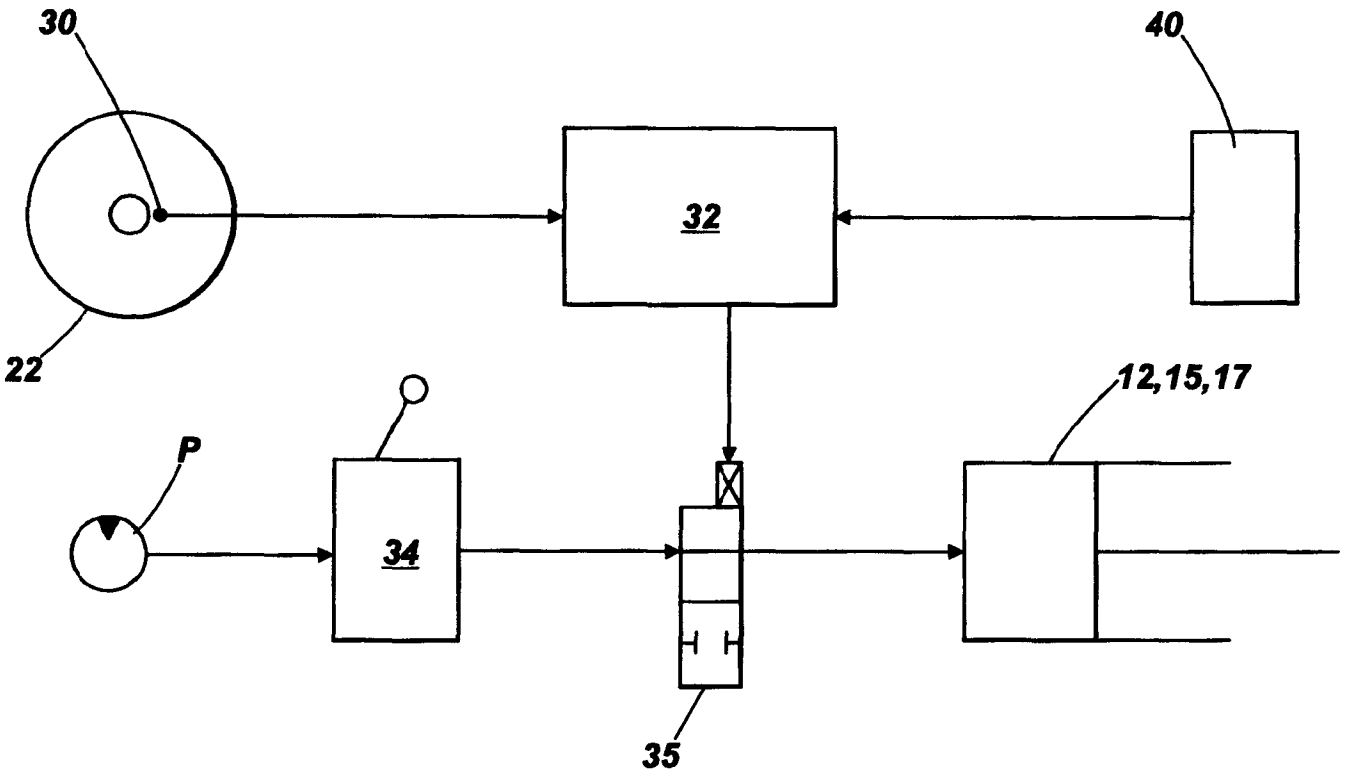
FIG. 3 is a diagram of a part of a hydraulic circuit of the machine of FIGS. 1 and 2.

It will be appreciated that the machine 10 depicted in FIG. 1 and FIG. 2 is purely exemplary. Instead of the illustrated loading forks 16, another kind of working implement 16 could be provided, such as a loading or even an excavating bucket. The working arm 14 need not be a loading arm as shown, but could be another kind of loading arm such as a backhoe used for excavating. Where the working arm 14 is a loading arm, the arm may be mounted at the front instead of the rear of the machine body 11 or elsewhere on the body 11. The working arm 14 may carry a hook or magnet for raising the load cranewise, and need not be telescopic as described.

The longitudinal load moment sensor 30 need not be provided on the rear axle 19, but may be provided by an alternative type of sensor and/or in an alternative position provided that the sensor 30 is able to determine the longitudinal load moment and provide an appropriate signal to the controller 32 by means of which the controller 32 can determine whether or not the longitudinal load moment of the machine 10 is or is not within a safe limit, i.e. less than a predetermined instability.

The ground engaging drive structure need not include two pairs of wheels 20, 21 but may include one or more pairs of tracks. The transmission 24 may be mechanical and/or hydrostatic as desired.

The cab 20 need not be mounted on the body 11 as shown that is the rear of the body 11 and at one side of the working arm 14 but may be mounted elsewhere. The machine 10 may have more than one working arm 14, and thus may be of the kind of working machine known as a backhoe loader.

Desirably, or indeed necessarily to comply with legislation in some territories, the machine 10 may include a longitudinal movement indicator to at least provide a warning to an operator of an impending longitudinal unstable condition. If, in accordance with the method of the invention, the longitudinal load movement control system may be disabled, the load movement indictor may continue to provide a visual indication to the operator of the longitudinal starting status of the machine 10.

The invention claimed is:

1. A method of operating a working machine which includes a main structure and a working arm, the working arm being pivotally mounted on the main structure at one end of the arm, the working arm being raisable and lowerable relative to the main structure by a first actuator device, and being extendible relative to the main structure by a second actuator device, and the arm carrying in use at its other end a working implement which in use carries a load, the machine further including a ground engaging drive structure by which the machine is driveable on the ground, and the machine having a longitudinal load moment control system which is functional automatically to prevent the operation of the first and/or second actuator device which would increase longitudinal instability in the event that a predetermined machine longitudinal instability is sensed, the method including sensing a parameter relating to the travelling speed of the machine on the ground, and where the machine is determined to be travelling at a speed above a threshold speed, disabling the longitudinal load moment control system so that operation of the first and/or second actuator device is permitted at least to counter a longitudinal instability caused by the machine traveling over an uneven ground surface.

2. A method according to claim 1 wherein the working arm is a loading arm which is pivoted relative to the main structure for up and down movement about a generally horizontal axis, at the one end of the working arm, at a rear position on the main structure, the working arm extending forwardly beyond the main structure at the other end, where the working implement is provided, the first actuator device extending between the main structure and the loading arm, the first actuator device being extendable to raise the arm and retractable to lower the arm, the method including extending or retracting the first actuator device and sensing the longitudinal load moment.

3. A method according to claim 1 wherein the loading arm is telescopic, having a plurality of arm sections, the second actuator device extending between adjacent sections of the arm, which second actuator device is extendable or retractable to extend or retract the loading arm, the method including extending or retracting the second actuator device, and sensing the longitudinal load moment.

4. A method according to claim 1 wherein the first and second actuator devices are provided in a hydraulic circuit which includes a longitudinal load moment control system device the method including operating the longitudinal load movement control system device under the control of a controller, to prevent the flow of hydraulic fluid to or from at least one of the actuator devices when the longitudinal load moment control system is operational and longitudinal instability is sensed which is greater than the predetermined machine longitudinal instability.

5. A method according to claim 1 wherein the method includes sensing movement of the machine relative to the ground to sense machine travelling speed.

6. A method according to claim 5 wherein the method includes providing a signal to a controller indicative of the machine travelling speed, the controller disabling the longitudinal load moment control system when the travelling speed is determined to be above the threshold speed.

7. A method according to claim 1 wherein the method includes sensing the speed of the machine on the ground by sensing movement of a rotational part of the ground engaging drive structure which moves as the machine moves on the ground.

8. A method according to claim 1 wherein the method includes sensing the movement of a transmission component to determine the travelling speed of the machine on the ground.

9. A method according to claim 8 which includes sensing movement of one of a clutch element, and a gear, and a shaft, to determine the travelling speed of the machine over the ground.

10. A method according to claim 1 wherein the threshold speed is less than 5 kph.

11. A method according to claim 10 wherein the threshold speed is not more than 0.5 kph.

12. A method according to claim 11 wherein the threshold speed is zero kph.

13. A working machine which includes a main structure and a working arm, the working arm being pivotally mounted on the main structure at one end of the arm, the working arm being raisable and lowerable relative to the main structure by a first actuator device, and being extendible relative to the main structure by a second actuator device, and the arm carrying in use at its other end a working implement which in use carries a load, the machine further including a ground engaging drive structure by which the machine is driveable on the ground, and the machine having a longitudinal load moment control system which is functional automatically to prevent the operation of the first and/or second actuator device which would increase longitudinal instability in the event that a predetermined machine longitudinal instability is sensed, the machine further including a sensor to sense a parameter relating to the travelling speed of the machine on the ground, and to provide a signal to a controller, indicative of whether the travelling speed of the machine is above or below a threshold speed, and where the machine is determined to be travelling at a speed above a threshold speed, the controller disabling the longitudinal load moment control system so that operation of the first and/or second actuator device is permitted at least to counter a longitudinal instability caused by the machine traveling over an uneven ground surface.

14. A method of operating a working machine, the method comprising:

providing a working machine comprising a main structure, a working arm, and a ground engaging drive structure, the working arm having a first end pivotally mounted on the main structure and a second end attachable to a working implement used to carry a load, the working arm being raisable and lowerable relative to the main structure by a first actuator device, the working arm being extendible and retractable relative to the main structure by a second actuator device, the ground engaging drive structure being configured to move the working machine over a ground surface;

providing a longitudinal load moment control system including a control system controller, a load sensor arranged to sense a longitudinal instability, and a speed sensor arranged to indicate a travelling speed of the working machine over the ground surface;

providing a signal indicative of the longitudinal instability to the control system controller;

inputting the traveling speed to the control system controller;

determining whether the travelling speed is above or below a speed threshold;

when the travelling speed is below the speed threshold, enabling the longitudinal load moment control system so that operation of the first actuator device and/or the second actuator device is automatically prevented; and when the travelling speed is above the speed threshold, disabling the longitudinal load moment control system so that operation of the first and/or second actuator device is permitted in order to counter the longitudinal instability caused by the working machine traveling over an uneven ground surface.

15. The method of claim 14, comprising enabling operation of a visual indicator and/or audio indicator indicating an impending longitudinal instability when the longitudinal load moment control system is disabled.

* * * * *